US005514244A

United States Patent [19]

Krukas

[11] Patent Number: 5,514,244

[45] Date of Patent: May 7, 1996

[54] APPARATUS FOR APPLYING SEALING TAPE TO A STATIONARY CARTON

[76] Inventor: David Krukas, 279 Kohr Rd., Kings Park, N.Y. 11754

[21] Appl. No.: 402,855

[22] Filed: Mar. 13, 1995

[51] Int. Cl.[6] ..... B32B 31/00

[52] U.S. Cl. ..... 156/468; 156/355; 156/486; 156/492; 156/522

[58] Field of Search ..... 156/468, 486, 156/355, 475, 487, 477.1, 492, 522, 530

[56] References Cited

U.S. PATENT DOCUMENTS

| | | | |
|---|---|---|---|
| 2,317,943 | 4/1943 | Saltisberg | 156/486 |
| 4,039,367 | 8/1977 | Warshaw et al. | 156/486 |
| 4,061,526 | 12/1977 | Warshaw et al. | 156/468 |
| 4,640,731 | 2/1987 | Lerner . | |
| 4,936,945 | 6/1990 | Marchetti | 156/468 |

*Primary Examiner*—James Engel

[57] ABSTRACT

Apparatus for applying sealing tape to a stationary rectangular carton. As the carton is introduced into the taping area, a tape applicator applies a pre pulled tape length from the tape supply to the carton front vertical panel and extends the tape down into the main frame. A cutter severs a tape length inside the main frame. A wiping member that follows the cutter, wipes the severed tape length around the corner formed by the front vertical panel and onto horizontal panel for the length between the corner of the carton and the cutter. On the return stroke a pre pull member pre pulls the next tape length from the tape supply to be applied on the next carton.

20 Claims, 7 Drawing Sheets

APPARATUS FOR APPLYING SEALING TAPE TO A STATIONARY CARTON

BACKGROUND OF THE INVENTION

The present invention relates in general to tape sealing of rectangular cartons or boxes with tape courses or runs of pressure sensitive tape, and refers more particularly to tape sealing of a stationary paper board carton, which is not stiff enough and lacks tear resistant strength, with short "L" tape runs of narrow pressure sensitive tape from the vertical front panel onto horizontal panel, that is onto the carton top or bottom, where the tape course is terminated.

It is common practice to tape seal rectangular shipping cases or cartons with a continuous length of sealing tape, such as a pressure sensitive type, the tape being applied first at the front wall of the carton onto and along either or both the bottom or top wall if upper and lower sealing courses are used, and then onto the rear wall, the tape courses along the top and bottom walls overlapping and sealing infolded closure flaps in place on the carton. The tape applied at the front and rear walls provides an anchorage length to securely hold the tape lay down at the top and bottom walls so that, e.g., any imposed loading of carton contents on the bottom wall cannot breach the tape seal along that surface or the top flaps cannot readily accidentally become opened, e.g., the type of machine described in U.S. Pat. No. 4,039,367.

The "L" tape applying machines are used where shorter courses of sealing tape suffice, thereby resulting in significant savings in the quantity of sealing tape required in connection with box or carton packing operation, e.g., the type of apparatus described in U.S. Pat. No. 4,640,731

Representative of such instances are full telescopic cartons wherein a cover or lid fits over a bottom or tray member where the tray is filled with product and a companion rectangular cover member is telescoped over the base and tape sealed. The tape courses or runs with which such cartons can be sealed could follow "L" tape runs at the carton vertical panels and onto the carton horizontal panel, where the tape courses are terminated. In case of a telescopic box two or more "L" tape courses can be applied to each carton side and bottom panel.

Other instances when effective tape securement can be achieved with "L" tape runs of pressure sensitive tape is sealing of one piece tuck-in, full overlap and other widely used types of carton.

While pressure sensitive tape is widely used for tape sealing of rectangular shipping cartons, the use of pressure sensitive tape is not common on structurally weak paperboard cartons also known as chipboard cartons. More common ways of securing paperboard cartons is gluing, cellophane wrapping or shrink wrapping.

When pressure sensitive tape is used for tape sealing of chipboard cartons to make the carton temper resistant or to protect the product, the taping operation is usually performed by hand what is highly labor intensive and marked by low production rate, is not uniformed what makes it aesthetically unappealing and unnecessary costly. The reason for manual taping is that most known "L" clip applying machines are designed to apply tape to structurally sound corrugated box, cannot be used on a carton which is not stiff enough and locks tear-resistance strength.

The tape sealing apparatus described in U.S. Pat. No. 4,640,731 is designed for applying "L" tape runs of pressure sensitive tape to a forwardly traveling corrugated box. This device and manner of applying "L" tape courses of pressure sensitive tape has a number of disadvantages, viz., a. The device requires a machine with transporting belts to move a carton in forwardly directed travel. The device cannot function without a machine that incorporates transporting belts.

b. The device doesn't have a taping area where the vertical and horizontal carton walls held together during tape application. Failure to squeeze together vertical and horizontal walls of structurally weak carton can result in a poor seal with a loop of pressure sensitive tape formed between the vertical and horizontal carton walls.

c. The device does not have a tape pre-pull mechanism. The tape is applied directly to the wall of the carton and by moving on transporting belts the carton pulls and unwinds the tape from the tape stock. The resistance of the tape being unwind off the tape roll and pulled through the taping apparatus can be too great for a structurally weak carton what can result in collapse of the carton walls.

d. The device requires for the carton to be rigid enough to compress the spring loaded arms of the taping mechanism.

A device for applying "L" tape courses of a reinforced filament tape to a stationary box being marketed by 3M Company of St. Paul, Minn. under trade name of 3M Matic S-847. This device and manner of applying L-clip has a number of disadvantages, viz., a. The device operates only with a high performance filament tape. It cannot operate with a regular, commonly used film tape.

b. The device can apply only a long piece of filament tape (4.5" long "L" tape course) what can be unacceptable for small size cartons.

c. The use of reinforced filament tape for tape sealing of structurally weak cartons, which cannot be used to carry large weight, is wasteful of reinforced filament tape.

d. The box introduced into the taping area has to be rigid enough to compress two spring loaded sensing devices in order to activate taping mechanism.

Another product marketed by 3M Company of St. Paul, Minn. is S-36 Manual Box Closer that can apply film as the carton is pushed across the top of the unit. This device and manner of applying "L" clip has a number of disadvantages, viz., a. The device requires for the carton to be pushed across the top of the unit, what is inconvenient and labor intensive.

b. The device requires for the carton to be rigid enough to compress the mechanical spring loaded arms of the mechanism, what is not the case on a structurally weak carton.

c. In operation the device can use only small rolls of pressure sensitive tape located inside the frame of the S-35 Manual Box Closer, what becomes a big inconvenience in high volume industrial applications.

d. The device doesn't have a taping area where the vertical and horizontal carton walls held together during tape application. Failure to squeeze together vertical and horizontal walls of a structurally weak carton can result in a poor seal with a loop of pressure sensitive tape formed between the vertical and horizontal carton walls.

e. The device does not have a tape pre-pull mechanism. The tape is applied to the front wall of the carton and the carton, pushed by the operator through the taping mechanism, pulls and unwinds the tape from the tape stock. The resistance of the tape being unwind off the tape roll and pulled through the taping apparatus can be too great for the structurally weak carton, what can result in collapse of the carton walls.

It is therefore desirable that an improved apparatus to be provided for forming a "L" clip courses of tape on a carton, which is not stiff enough and locks tear resistance strength and apparatus that do not have the undesirable shortcomings noted above, It is also understood that the introduced taping apparatus that can apply "L" clip courses of tape on the carton which is not stiff enough and locks tear resistance strength can also be used in sealing of structurally sound cartons.

SUMMARY OF THE PRESENT INVENTION

An object of the present invention is to provide an improved carton taping apparatus for applying "L" tape sealing courses around the corner formed by the front vertical panel and onto horizontal panel, that is onto the carton top or bottom, to a stationary carton introduced into a taping area.

Another object is to provide a tape sealing apparatus for cartons that are not stiff enough and lock tear-resistance strength.

A further object is to provide an apparatus for applying a short length of narrow pressure sensitive tape to a stationary carton introduced into the taping area.

A still further object is to provide a tape stock for use in a taping apparatus in a form of tape cartridge, that holds a large diameter roll of narrow pressure sensitive tape and protects the tape from bending and telescoping.

The present apparatus consists of a main frame FIG. 2 with the tape stock rotatably mounted in the back of the main frame. The tape loading area is located on the side of the main frame covered by a safety cover. When the pressure sensitive tape is loaded into the taping apparatus, the safety cover should be opened, what would release the safety sensor and disconnect the air supply, for safety reasons, from the power control unit. A length of pressure sensitive tape must be unwind from the tape stock and introduced into the tape loading window, placed through a number of tape guiding rollers and a pre-pull roller and between the tape applicator and tape support plate. After the safety cover is closed, safety sensor is activated, and air supply is connected to the power control unit and the apparatus is ready for operation.

The taping area is located in front of the main frame, where the carton can be introduced for tape application. The taping area consists of horizontal and vertical support plates, a tape applicator window and a carton sensing device. When the carton is placed on the horizontal support plate and pushed against the vertical support plate, into the corner formed by the vertical and horizontal support plates, right before the carton will reach the vertical support plate, first the front wall of the carton will meet the tape applicator which is located in the tape applicator window, where the tape applicator will present the pressure sensitive tape supported by the tape support plate to the front vertical wall of the carton. Then, right before the front wall of the carton will reach the vertical support plate it will activate the carton sensing device. When the presence of the carton is detected in the taping area and the power control unit is activated by the carton sensing device, the power control unit will effect the striking of the power operable unit like a cylinder unit and the power operable unit will put in motion the taping mechanism.

The taping mechanism is located inside the main frame FIG. 3, FIG. 4, and FIG. 5 and consists of the main moving carriage rotatably mounted on the main frame, where the main moving carriage carries the tape applicator unit, a pre-pull member, and a secondary moving carriage. The secondary moving carriage is rotatably mounted on the main moving carriage and caries a cutter means and the wiping means.

The cylinder unit is pivot mounted on the main frame and the cylinder piston rod is pivot mounted to the secondary moving carriage. Right before the carton sensing device is activated, the cylinder unit is holding the secondary moving carriage in a back stop position against the stop located on the main moving carriage, and by doing so holding the main moving carriage against the bias means in a position, where the tape applicator unit is positioned to present the pressure sensitive tape through the tape applicator window to the front wall of the carton FIG. 3.

When the carton that is introduced into the taping area activates the carton sensing device, the cylinder unit starts forcing the secondary moving carriage, but instead of moving the secondary moving carriage against bias means, it moves the main moving carriage assisted by bias means in a circular motion around fixed axis located on the main frame. The tape applicator that is located on the main moving carriage, applies and wipes a pre-pulled length of pressure sensitive tape to the front vertical wall of the carton and extends the tape down below the bottom carton wall into the main frame FIG. 4. When the main moving carriage comes to a stop on the main moving carriage stop, the cylinder unit will continue to force the secondary moving carriage against the bias means in a circular motion around a fixed axis located on the main moving carriage. The secondary moving carriage caries the cutter means and the wiping means which are positioned to cut and then wipe the severed tape length to the bottom wall of the carton. When the secondary moving carriage strikes forward, first the cutter severs a tape length inside the main frame below the carton bottom wall, then the wiping means that follow the cutter means wipe the severed tape length around the corner formed by the front panel and onto horizontal panel for the length between the corner of the carton and the cutter FIG. 5.

After the taping cycle is completed and the carton is removed from the taping area, the carton sensing device is deactivated and the power operable unit first moves the secondary moving carriage assisted by the bias means, back to the stop position FIG. 4, and then the main moving carriage against the bias means to its original position FIG. 3. On the return stroke of the main moving carriage, a pre-pull member located on the main moving carriage, pre-pulls a tape length from the tape supply against the tape guiding rollers located on the main frame. A pre-pulled length of tape from the tape supply will be released and applied in like manner to the next carton introduced into the taping area. The use of a flat flexible plate as a tape applicator and tape wiping means, introduced with the "L" tape applying apparatus not only made possible application of short length of pressure sensitive tape, but also allowed to produce gentle wipe where the edge of the flat flexible plate follows the contours of the carton walls and applies a uniform quality "L" tape seal.

It is not practical for industrial applications to use small diameter rolls of pressure sensitive tape. The use of large diameter rolls of narrow width pressure sensitive tape is not common, because the large diameter rolls of narrow width pressure sensitive tape have a tendency to bend and telescope in storage, during installation onto the taping machine or in operation. The tape cartridge introduced into "L" tape applying apparatus is designed to solve those problems. The tape cartridge consist of a roll of a narrow pressure sensitive tape with two flat support plates located on both sides of the roll, where the tape roll and the support plates are mounted on a tape core FIG. 7, where the said support plates prevent the narrow roll of pressure sensitive tape from bending and telescoping.

The invention accordingly comprises the features of construction, combination of elements, and arrangement of parts in carton taping apparatus which will be exemplified in the construction hereinafter set forth and the scope of the invention will be indicated in the claims.

BRIEF DESCRIPTION ON THE DRAWINGS

A fuller understanding of the nature and objects of the invention will be had from the following detailed description taken in conjunction with the accompanying drawings, in which.

Figure 1:
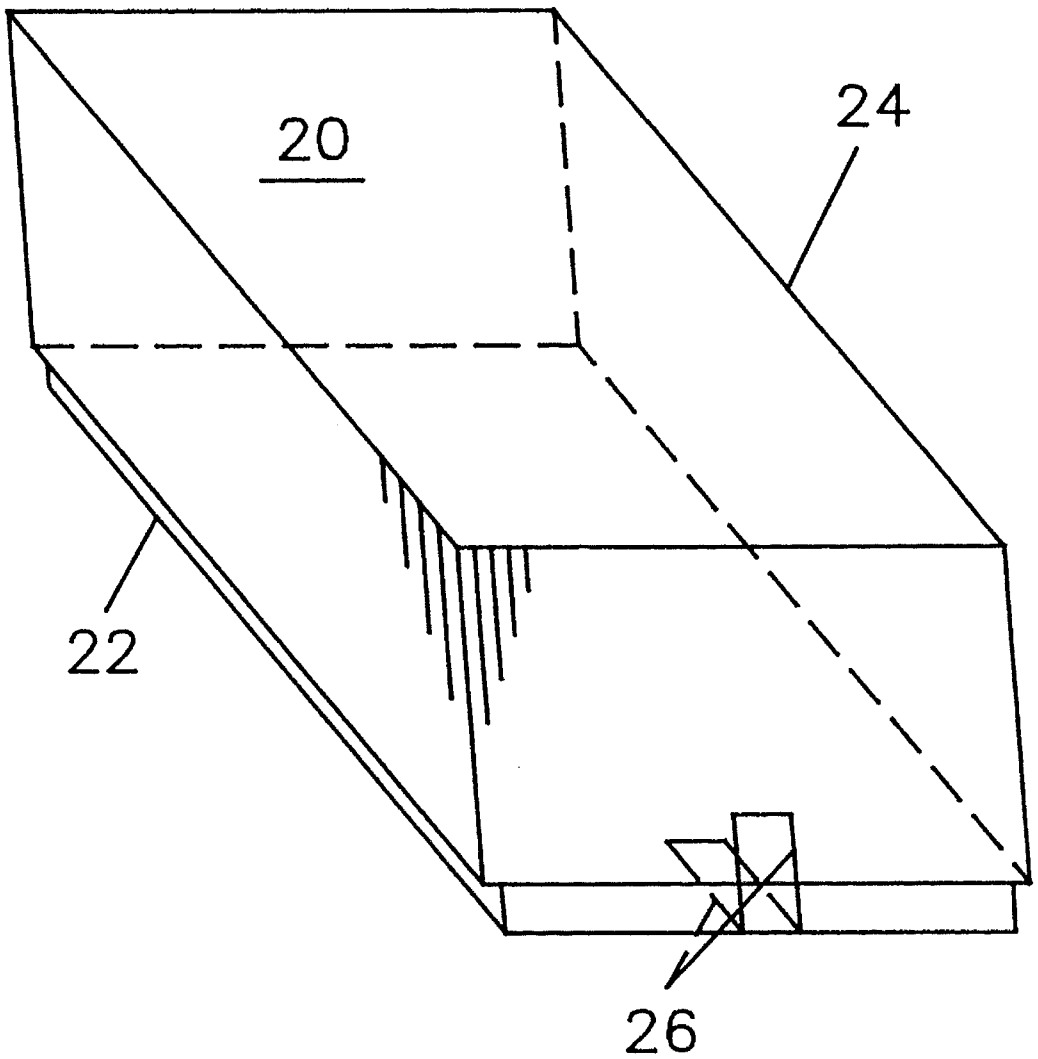
FIG. 1 is a perspective view of a carton showing the manner in which a "L" type course is applied at the front end of the carton of the apparatus of the present invention.

DRAWING REFERENCE NUMERALS:

20 telescopic carton
22 telescopic carton base of 20
24 telescopic carton cover member of 20
26 "L" tape course of tape of 20
28 main frame
30 tape cartridge
32 pressure sensitive tape of 30
34 tape loading window of 28
36A tape guiding roller of 28
36B tape guiding roller of 28
36C tape guiding roller of 28
36D tape guiding roller of 28
36E tape guiding roller of 28
38 tape applicator of 68
40 tape support plate of 68
42 safety cover of 28
44 safety sensor of 28
46 tape applicator window of 28
48 carton taping area of 28
50 horizontal support plate of 28
52 vertical support plate of 28
56 carton sensing device of 28
58 cylinder unit
60 cylinder unit mounting of 28
62 cylinder rod of 58
64 secondary moving carriage
66 cylinder rod pivot of 64
68 main moving carriage
70 center of rotation of secondary moving carriage
72 cutter means of 64
74 wiping means of 64
74A wiping means for wiping the front wall of the carton
76 secondary moving carriage spring
78 secondary moving carriage spring mounting point of 64
80 main moving carriage spring mounting point of 68
82 secondary moving carriage stop of 68
84 center of rotation of the main moving carriage
86 pre-pulled roller of 68
88 main moving carriage spring
90 main moving carriage spring mounting point of 68
92 spring frame mounting point of 28
94 main moving carriage stop of 28
96 secondary moving carriage stop of 68
98 roll of pressure sensitive tape of 30
100 tape core of 30
102 support plate of 30
102A support plate of 30
104 air line
106 filter
108 pressure reducer
110 air line
112 air line
114 air line
116 air line
118 air line
120 air line

DESCRIPTION OF THE PREFERRED EMBODIMENTS

FIG. 1 shows a telescopic carton 20 with the base 22 and the cover member 24 sealed with a "L" tape course of tape 26 applied at the front vertical wall of the carton 20 and around the corner formed by the front vertical panel and onto horizontal panel. It will be understood and appreciated by those skilled in the art, that the described carton types is merely exemplary of the wide range of cartons and such construction thereof as can be taped with the apparatus of the invention. Further, and as those skilled in the art, readily will discern the apparatus while depicted and described as being at the carton bottom side can also be used at the top side, or in fact, at the side walls by suitable mounting of same, so that taping can be effected at one, two, or four sides of the carton, if desired.

Further, and those skilled in the art, readily will understand that named apparatus that is able to seal structurally weak cartons, can also seal structurally sound carton. It is also understood that an apparatus that is able to apply short length of tape can be used to apply long length of pressure sensitive tape.

Figure 2:
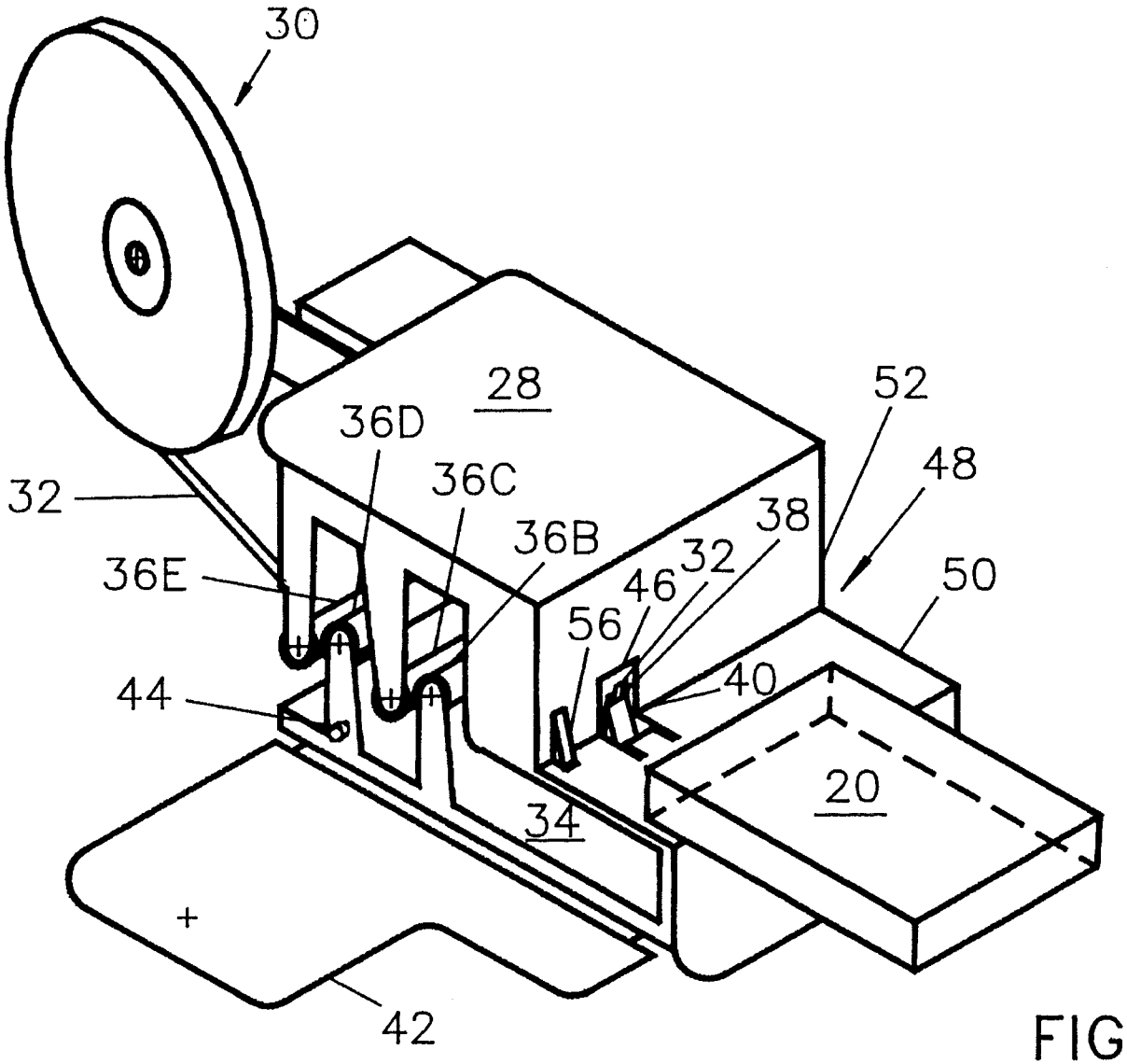
FIG. 2 is a perspective view of the taping apparatus of the present invention showing a carton being introduced into the taping area.

FIG. 2 shows the general overall constructual features of the present apparatus that consists of a main frame 28 that supports a tape cartridge 30 which supplies pressure sensitive tape 32 to the taping apparatus. The tape is inserted through the tape loading window 34 through a number of tape guiding rollers 36A, 36B, 36C, 36D,36E and the pre-pull roller 86 FIG. 3,4, and FIG. 5, into the main frame 28 and between the tape applicator 38 and the tape support plate 40. When the tape is installed into the taping apparatus the tape loading window 34 must be closed by the safety cover 42. When the safety cover 42 is in closed position, the safety sensor 44 is activated and the taping apparatus is ready for operation. The tape applicator 38 and the tape support plate 40 are located in the tape applicator window 46, where the tape applicator window 46 is part of the carton taping area 48. The taping area 48 consists of the horizontal support plate 50 that supports carton 20 introduced into the taping area, and the vertical support plate 52 that serves as a stop when the carton is pushed into the corner formed by the horizontal support plate 50 and vertical support plate 52. On the side of the tape applicator window 46 is located a carton sensing device 56 which is positioned to sense the presence of a carton 20 introduced into the taping area.

Figure 3:
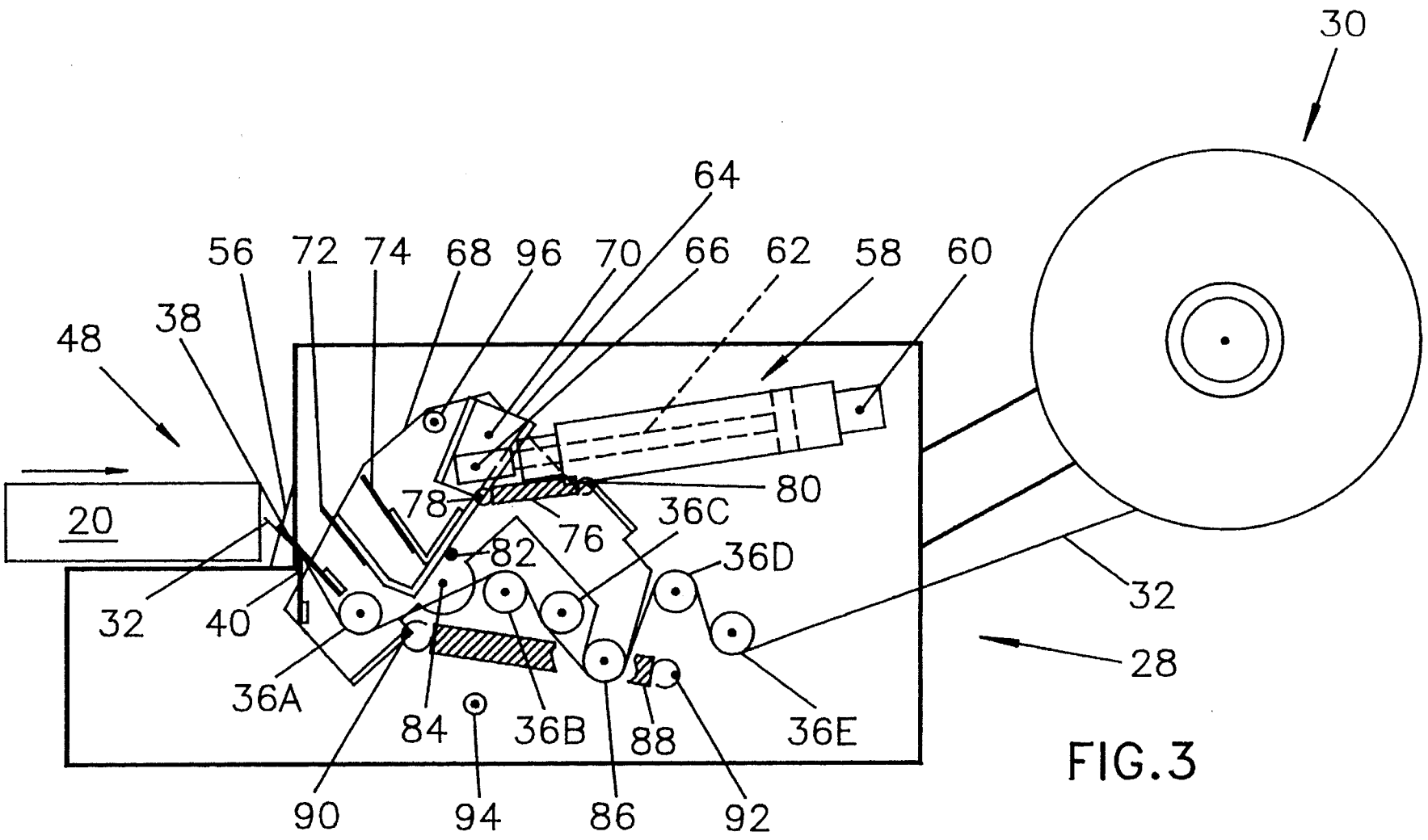
FIG. 3 is a side elevational view with portions cut away of the taping apparatus of the present invention showing the carton being introduced in the taping area

FIG. 3 shows the general overall constructional features of the present apparatus, the former various components are in projecting position, when the carton 20 is introduced into the taping area 48 and the tape 32 gets in contact with the front wall of the carton 20, right before the front wall of the carton 20 gets in contact with the carton sensing device 56 which is in circuit with means admitting air to a cylinder unit 58, or like power motive unit such as an electrical solenoid unit, which is pivot mounted on the main frame 28 at pivot 60. The cylinder road 62 of the cylinder unit 58 is pivot mounted on the secondary moving carriage 64 at a pivot 66, and the secondary moving carriage 64 is pivot mounted on the main moving carriage 68 at pivot 70, and carries cutter means 72 and wiping means 74. The secondary moving carriage spring 76, which is mounted on a secondary moving carriage at mounting point 78, and on main moving carriage at mounting point 80 is holding the secondary moving carriage 64 against the secondary moving carriage stop 82 located on the main moving carriage 68. The main moving carriage 68 is rotatably mounted on the main frame 28 at center of rotation 84 and carries the tape applicator 38, and a tape support plate 40, a pre-pull roller 86 and the secondary moving carriage 64. A main moving carriage spring 88, which is attached to the main moving carriage 68 at mounting point 90, and on the main frame 28 at the mounting point 92 is forcing the main moving carriage in tape applying direction. A cylinder unit 58 which is pivot mounted on the main frame 28 at a mounting point 60 is holding the secondary moving carriage 64 in a stop position at the secondary moving carriage stop 82 and through the secondary moving carriage stop 82 and through the center of rotation 70 of the secondary moving carriage 64 is holding the main moving carriage 68 against the main moving carriage spring 88 in a position where the tape applicator 38 located on the main moving carriage 68 is positioned to present the pressure sensitive tape 32 to the front wall of the carton 20.

Figure 4:
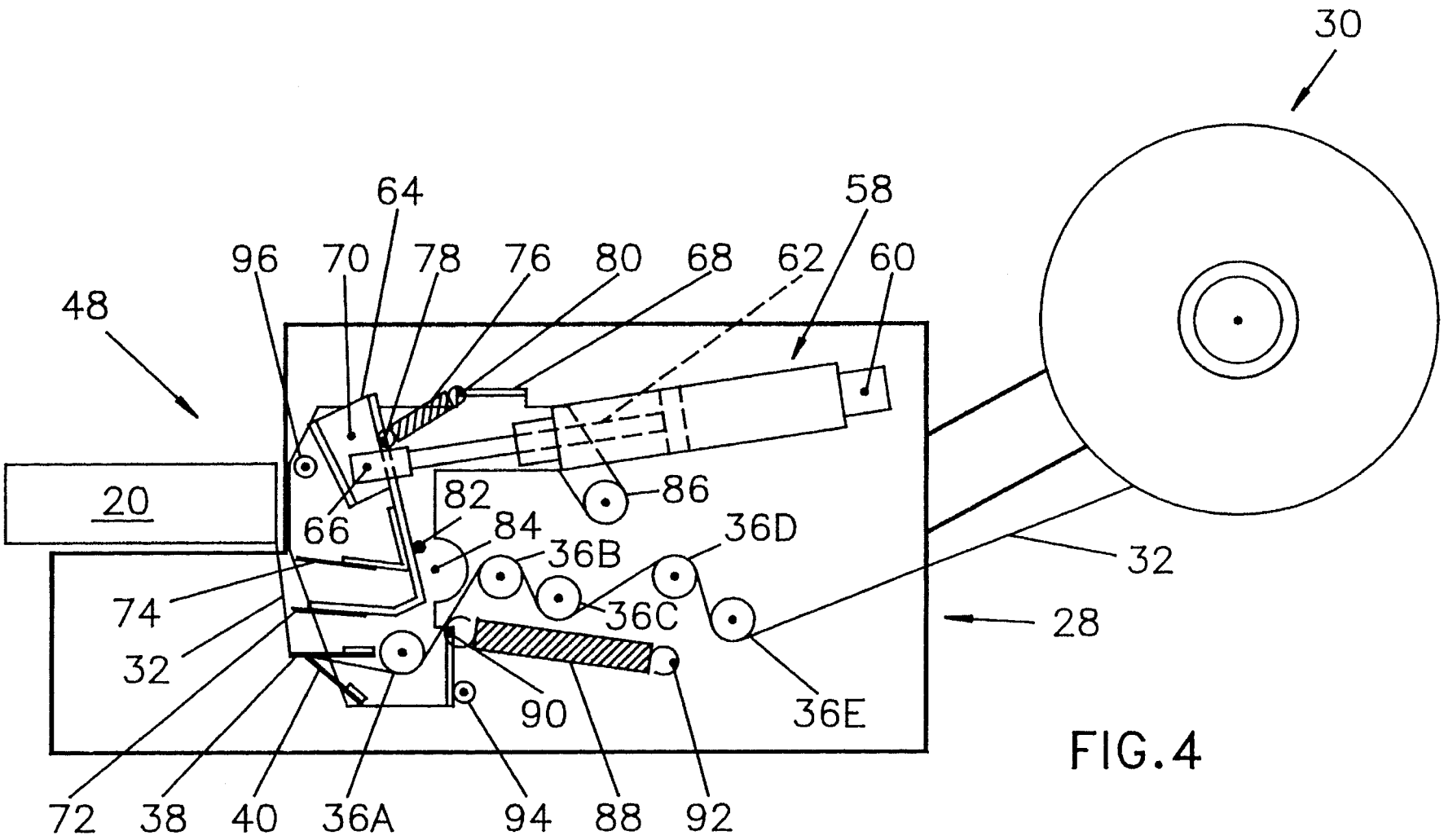
FIG. 4 is a side elevational view with partial cut away of the taping apparatus of the present invention showing the stage where the tape is applied to the front vertical wall of the carton and extended into the main frame.

FIG. 4 shows the general overall constructional features of the present apparatus, the former, when the carton 20 activated the carton sensing device 56 FIG. 2, and the air flow is reversed in the cylinder unit 58. The cylinder rod 62 forced the secondary moving carriage 64 through the cylinder rod pivot point 66, but instead of stretching the spring 76 mounted at point 78 on the secondary moving carriage 64, and at point 80 at the main moving carriage 68, it moved the main moving carriage 68 to a stop position on the main moving carriage stop 94, assisted by the main moving carriage spring 88, which is attached to the main moving carriage 68 at mounting point 90, and on the main frame 28 at the mounting point 92, and displayed a length of tape 32 between the front wall of the carton 20 and the tape applicator 38.

Figure 5:
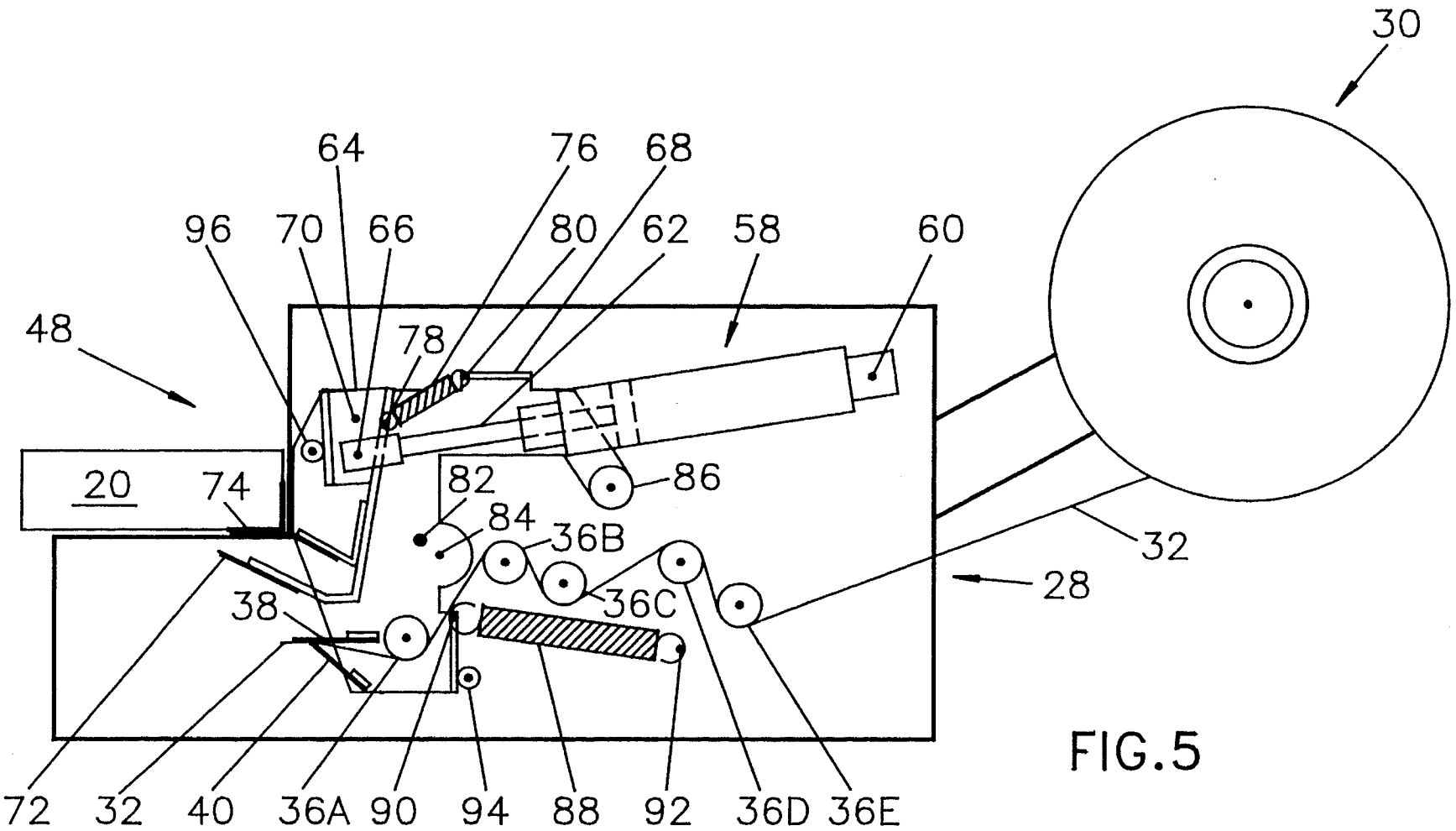
FIG. 5 is a side elevational view with portions cut away of the taping apparatus of the present invention showing the final stage after the tape is cut and wiped to the bottom wall of the carton.

FIG. 5 shows the general overall constructional features of the present apparatus, the former, when the carton sensing device 56 FIG. 2 is still activated by the carton 20, and the cylinder rod 62 is forcing the secondary moving carriage 64 through the cylinder rod pivot point 66 around the center of rotation 70 of the secondary moving carriage 64, but because the main moving carriage 68 reached the main moving carriage stop 94 the cylinder rod 62 moved the secondary moving carriage 64 around the center of rotation 70, against the spring 76 mounted at point 78 on the secondary moving carriage 64, and at point 80 at the main moving carriage 68, to a stop position on the secondary moving carriage stop 96. When the secondary moving carriage 64 moved to the front position, the cutter means 72 severed a length of the pressure sensitive tape 32 and the wiping means 74 wiped the severed length of tape to the bottom wall of the carton 20.

Figure 6:
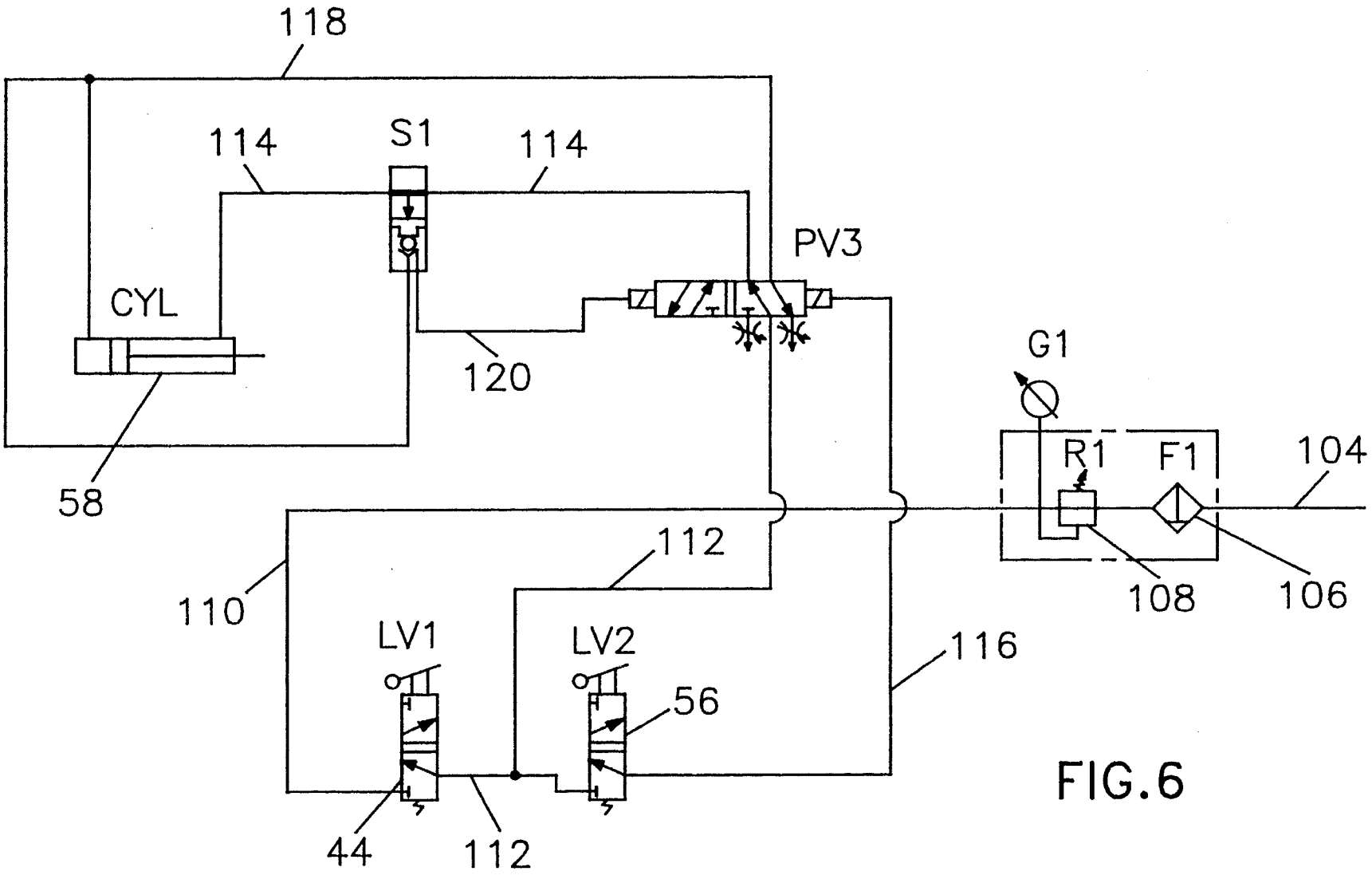
FIG. 6 is an air control circuit diagram depicting the control arrangement for moving the tape applying, cutting and wiping mechanisms of the present invention.

FIG. 6 shows the air control system. Pressurized air from source 104 passes through filter 106, pressure reducer 108, and supply line 110 to valve LV1 (safety sensor 44 FIG. 2). When the safety cover 42 is in closed position, the core of the valve SV1 is open and the air through line 112 supplies to the power control unit PV3 and valve LV2 (carton sensing device 56 FIG. 2). The power control unit PV3 supplies air through line 114 to the air cylinder 58 FIG. 3, which is holding the secondary moving carriage 64 in a back stop position against the stop 82 located on the main moving carriage 68 and by doing so holding the main moving carriage 68 against the bias means 88 in a position where the tape applicator unit 38 is positioned to present the pressure sensitive tape 32 to the front wall of the carton 20 FIG. 3. As soon as the presence of the carton 20 is detected in the taping area, the core of the valve LV2 (carton sensing device 56 FIG. 2) will be open and the air through line 116 would shift the core of the power control unit PV3 and pass air through line 118 to air cylinder 58 to strike the main moving carriage 68 and then the secondary moving carriage 64 FIG. 4 and 5. As soon as the tape is applied to the carton and the carton is removed from the taping area, the core of the valve LV2 would shift to close position. The pressure sensing device S1 will sense the end of the stroke of the cylinder unit 58 and through line 120 will shift the core of the power control unit PV3 and supply the air to the apposite side of the cylinder unit 58 through line 114. What would reverse the mechanism and prepare the apparatus for the next tape application.

Figure 7:
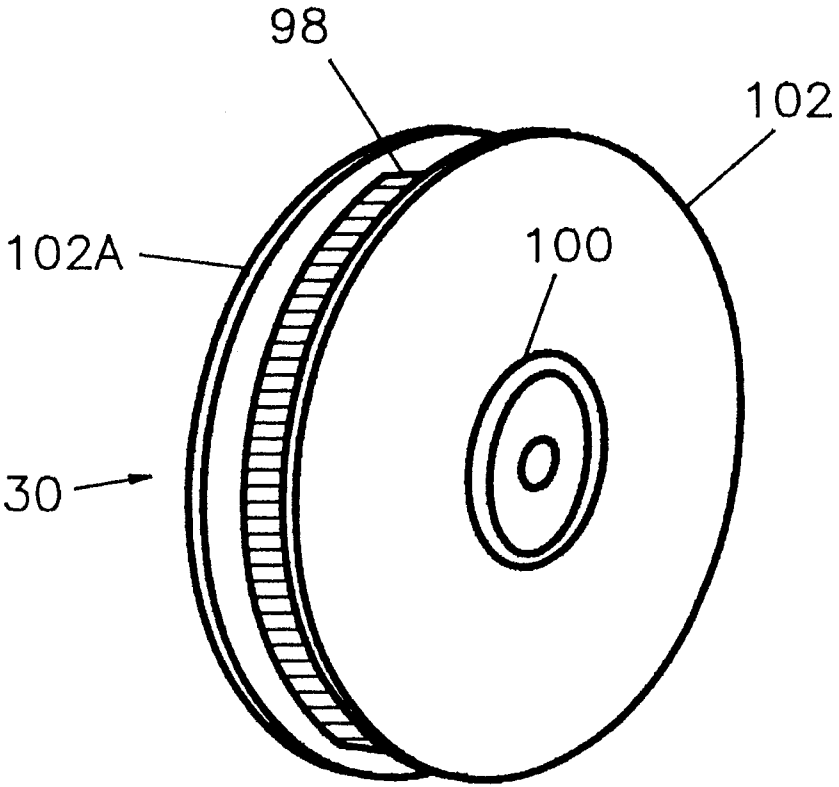
FIG. 7 is a perspective view of a tape cartridge of the present invention showing a roll of narrow pressure sensitive tape mounted on a core and supported on both sides by two support plates.

FIG. 7 shows the general overall constructional features of the tape cartridge 30 that consists of a roll of pressure sensitive tape 98 mounted on a tape core 100 and supported on both sides by flat support plates 102 and 102A.

Figure 8:
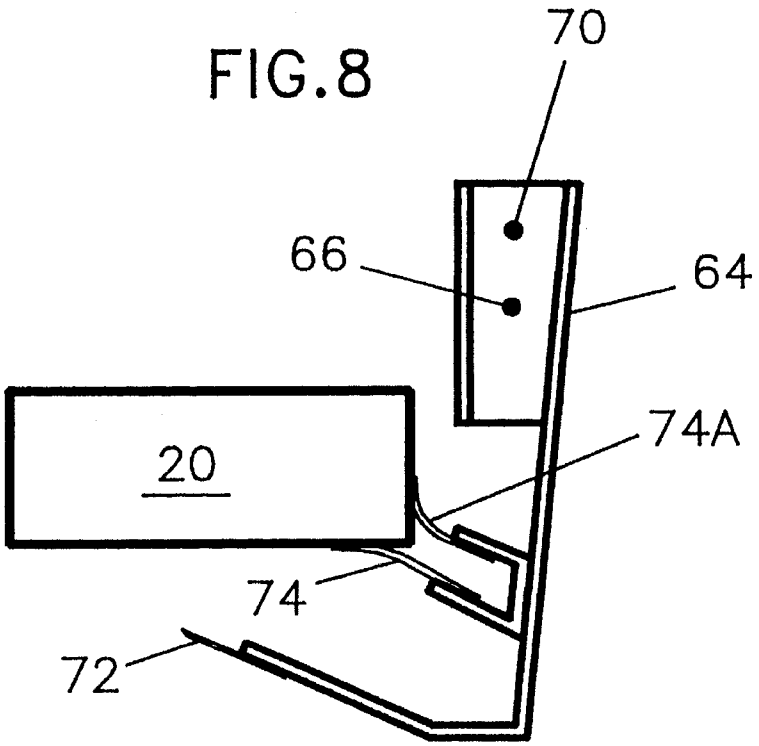
FIG. 8 is a side elevational view of the secondary moving carriage that has two wiping plates.

FIG. 8 shows general overall constructional features of the secondary moving carriage 64 that carries two wiping members 74 and 74A for wiping of the vertical and horizontal walls of the carton 20, where the wiping means are two flat flexible plates.

It will be seen that the present invention provides an important improvement in taping apparatus applying "L" tape courses to a structurally weak stationary carton. It will be appreciated that various modification can be made to the apparatus without departing from the scope of the inventive concept disclosed.

What is claimed is:

1. Apparatus for applying sealing tape to a stationary rectangular carton where the tape run is applied in part on the carton vertical panel and around in part into carton horizontal panel, said apparatus comprising a main frame structure, a tape stock positioned on said main frame, a taping area located on the said main frame with means of sensing the carton and activating a power operable unit, a movably mounted main moving carriage positioned on said main frame and normally biased in tape applying direction and said power operable unit countering said bias means, a tape applicator located on said main moving carriage and positioned to present tape from said tape stock thereof in confrontation to the carton front panel, during operation of said main moving carriage triggered by striking of said power operable unit, a tape support plate located on said main moving carriage and positioned to support the tape against the said tape applicator, a pre pull member located on said main moving carriage, said pre pull member is positioned to release a pre pulled length of tape into said tape applicator during tape application and said pre pull member is positioned to pre pull a length of tape from said stock thereof on the return stroke of said main moving carriage, a secondary moving carriage movably mounted on said main moving carriage and normally biased against the said main moving carriage to retract in a direction opposite the tape cutting and wiping direction, said power operable unit connected to said secondary moving carriage for striking first the said main moving carriage and then said secondary moving carriage on application of power to said power operable unit, a tape cutter means located on said secondary moving carriage and positioned for striking in cutting direction to sever a length of tape from said tape stock, a tape wiping means located on said secondary moving carriage positioned to follow said cutting means and wipe the severed length of tape to the carton horizontal panel.

2. The apparatus of claim 1 in which said tape applicator is a flat flexible plate located on said main moving carriage and positioned for flexing and wiping the tape to the box front wall.

3. The apparatus of claim 1 in which said wiping means is a flat flexible plate positioned for wiping the tape to the carton bottom wall.

4. The apparatus of claim 3 in which said tape wiping means are two flat flexible plates located parallel to each other and positioned to wipe respectively the bottom and the front vertical walls of the carton.

5. The apparatus of claim 1 in which said tape stock is a tape cartridge, for use in said taping apparatus that consists of a roll of pressure sensitive tape with two flat support plates located on both sides of the roll, the tape roll and the support plates are mounted on a tape core where said support plates prevent the roll of pressure sensitive tape from bending and telescoping.

6. The apparatus of claim 5 in which said support plates are made out of corrugated board.

7. The apparatus of claim 1 in which said power operable unit is a fluid operated cylinder.

8. The apparatus of claim 1 in which said power operable unit is a electrical solenoid.

9. The apparatus of claim 1 in which said pre pull member is a roller member fixed rotatably to said main moving carriage.

10. The apparatus of claim 1 in which said tape support plate is a flat flexible plate.

11. Apparatus for applying short length of narrow pressure sensitive tape to a stationary rectangular carton where the tape run is applied in part on the carton vertical panel and around in part into a carton horizontal panel, said apparatus comprising a main frame structure, a tape stock positioned on said main frame, a taping area located on the said main frame with means of sensing the carton and activating a power operable unit, a movably mounted main moving carriage positioned on said main frame and normally biased in tape applying direction and said power operable unit countering said bias means, a tape applicator located on said main moving carriage and positioned to present tape from said tape stock thereof in confrontation to the carton front panel, during operation of said main moving carriage triggered by striking of said power operable unit, a tape support plate located on said main moving cartridge and positioned to support tape against the said tape applicator, a pre pull member located on said main moving carriage said pre pull member is positioned to release a pre pulled length of tape into said tape applicator during tape application and said pre pull member is positioned to pre pull a length of tape from said stock thereof on the return stroke of said main moving carriage, a secondary moving carriage movably mounted on said main moving carriage and normally biased against the said main moving carriage to retract in a direction opposite the tape cutting and wiping direction, said power operable unit connected to said secondary moving carriage for striking first the said main moving carriage and then said secondary moving carriage on application of power to said power operable unit, a tape cutter means located on said secondary moving carriage and positioned for striking in cutting direction to sever a length of tape from said tape stock, a tape wiping means located on said secondary moving carriage positioned to follow said cutting means and wipe the severed length of tape to the carton horizontal panel.

12. The apparatus of claim 11 in which said tape applicator is a flat flexible plate located on said main moving carriage and positioned for flexing and wiping the tape to the box front wall.

13. The apparatus of claim 11 in which said wiping means is a flat flexible plate position for wiping the tape to the carton bottom wall.

14. The apparatus of claim 13 in which said tape wiping means are two flat flexible plates located parallel to each other and positioned to wipe respectively the bottom and the front vertical walls of the carton.

15. The apparatus of claim 11 in which said tape stock is a tape cartridge for use on said taping apparatus that consist of a large diameter roll of narrow width pressure sensitive tape with two flat support plates located on both sides of the roll, the tape roll and the support plates are mounted on a tape core where said support plates prevent the roll of pressure sensitive tape from bending and telescoping.

16. The apparatus of claim 15 in which said support plates made out of corrugated board.

17. The apparatus of claim 11 in which said power operable unit is a fluid operated cylinder.

18. The apparatus of claim 11 in which said power operable unit is a electrical solenoid.

19. The apparatus of claim 11 in which said pre pull member is a roller member fixed rotatably to said main moving carriage.

20. The apparatus of claim 11 in which said tape support plate is a flat flexible plate.

* * * * *